US010054030B2

(12) United States Patent
Duan et al.

(10) Patent No.: US 10,054,030 B2
(45) Date of Patent: Aug. 21, 2018

(54) ENGINE COOLING SYSTEMS AND METHODS

(71) Applicant: GM GLOBAL TECHNOLOGY OPERATIONS LLC, Detroit, MI (US)

(72) Inventors: Shiming Duan, Ann Arbor, MI (US); Christopher H. Knieper, Cheasaning, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 224 days.

(21) Appl. No.: 15/169,814

(22) Filed: Jun. 1, 2016

(65) Prior Publication Data

US 2017/0350303 A1 Dec. 7, 2017

(51) Int. Cl.

| | |
|---|---|
| ***F01P 5/12*** | (2006.01) |
| ***F01P 3/02*** | (2006.01) |
| ***F01P 7/16*** | (2006.01) |
| *F01P 7/14* | (2006.01) |

(52) U.S. Cl.

CPC ..... *F01P 5/12* (2013.01); *F01P 3/02* (2013.01); *F01P 7/165* (2013.01); *F01P 2007/146* (2013.01); *F01P 2023/08* (2013.01); *F01P 2025/04* (2013.01); *F01P 2025/08* (2013.01); *F01P 2025/64* (2013.01); *F01P 2031/18* (2013.01)

(58) Field of Classification Search

CPC ..... F01P 5/12; F01P 3/02; F01P 7/165

See application file for complete search history.

(56) References Cited

FOREIGN PATENT DOCUMENTS

JP 5317579 B2 * 10/2013
JP 2014-58931 A * 4/2014

* cited by examiner

*Primary Examiner* — Kevin A Lathers
(74) *Attorney, Agent, or Firm* — Reising Ethington, P.C.

(57) ABSTRACT

An engine coolant system includes a variable-opening valve having a plurality of tubes in fluid flow communication with an engine block and a radiator. The coolant system also includes an electrically-powered pump arranged to cycle coolant through the radiator and the engine block to regulate an engine temperature. The coolant system further includes a controller programmed to store a baseline relationship between pump speed and pump power draw using a non-linear scale. The controller is also programmed to detect a steady state operating condition of the pump, and identify an operational relationship between real-time pump speed and a pump power draw. The controller is further programmed to detect a coolant leak based on a deviation between the baseline relationship and the operational relationship.

20 Claims, 4 Drawing Sheets

ENGINE COOLING SYSTEMS AND METHODS

TECHNICAL FIELD

The present disclosure relates to vehicle powertrain cooling systems.

INTRODUCTION

Internal combustion engines generate significant heat and commonly require thermal management. Liquid coolant within a closed fluid circuit may be cycled through a block portion of an engine and other vehicle accessories to dissipate heat and maintain engine temperature within a desirable range. Coolant volume loss from the fluid circuit as well as flow obstructions may reduce efficacy of the temperature management, and potentially cause damage to engine components due to overheating.

SUMMARY

An engine coolant system includes a variable-opening valve having a plurality of tubes in fluid flow communication with an engine block, a radiator and at least one vehicle accessory. The coolant system also includes an electrically-powered pump arranged to cycle coolant through the radiator and the engine block to regulate an engine temperature. The coolant system further includes a controller programmed to store a baseline relationship between pump speed and pump power draw using a nonlinear scale. The controller is also programmed to detect a steady state operating condition of the pump, monitor an operational pump speed and a pump power draw, and estimate an operational relationship in real-time. The controller is further programmed to detect at least one of a coolant leak and a flow obstruction based on a deviation between the baseline relationship and the operational relationship.

A method of detecting a coolant flow anomaly such as at least one of a coolant leak and a flow obstruction includes setting a baseline value for a coolant flow characteristic based on a logarithmic relationship between stored operational speed data and stored power draw data of an electrically-powered coolant pump. The method also includes monitoring a speed characteristic and a power draw characteristic of the coolant pump. The method further includes storing data indicative of operational pump speed and pump power draw over a predetermined learning time duration in response to detecting a steady state operational speed of the coolant pump. The method further includes estimating a relationship between pump speed and a pump power and updating the estimate in real time. The method further includes detecting a reduction in a volume of coolant based on a deviation between an operational value and the baseline value of the coolant flow characteristic.

A system for detecting at least one of a coolant leak and a flow obstruction includes a controller programmed to store a baseline value for a coolant flow characteristic indicative of an initial volume of coolant and detect a speed characteristic and a power draw characteristic of an electrically-powered coolant pump. The controller is also programmed to store data indicative of pump operational speed and pump power draw over a predetermined learning time duration in response to detecting a steady state operational speed of the coolant pump. The controller is further programmed to estimate a real-time value for the coolant flow characteristic based on an operational relationship between pump speed and pump power and update the estimate in real-time based on new sensor data. The controller is further programmed to detect a reduction in a volume of coolant based on a change in the coolant flow characteristic from the baseline value.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
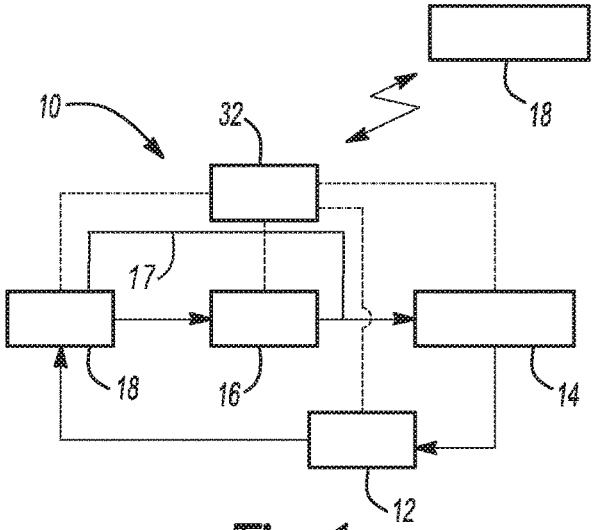
FIG. 1 is a system diagram of an engine cooling system.

Referring to FIG. 1, a vehicle powertrain cooling system 10 is arranged to cycle coolant through a closed-circuit fluid loop to regulate the temperature of engine 12. A coolant pump 14 includes an impeller which forces the liquid coolant through the system. Coolant is circulated throughout the engine block to absorb heat generated by the engine. After accumulating heat from the engine, the coolant is circulated through multiple-way gate valve 18. Depending on the vehicle operating conditions and cooling needs of the engine 12, the valve 18 distributes coolant flow to radiator 16 and bypass line 17 with a selectable ratio that is adjusted by modulating valve position. Heat is dissipated from the coolant at the radiator 16 due to air flowing across circulation tubes If engine temperature is low (e.g., following a cold start) higher coolant flow is directed through the bypass line 17 to reduce the time required to warm up the engine 12. Coolant is circulated back through the coolant pump to repeat the cycle in order to continuously cool the engine during operation.

While a single engine cooling circuit is depicted by way of example, multi-circuit cooling fluid systems may also benefit from aspects of the present disclosure. For example a hybrid vehicle having a high voltage traction battery may include an additional cooling circuit to manage battery temperature. Coolant flow may be characterized for each of the coolant circuits, both individually and collectively. This characterization allows for prompt detection of a coolant flow anomaly in a multi-circuit cooling system prior to the existence of detrimental symptoms as a result of the anomaly.

Often the coolant pump is a traditional mechanical pump which is driven by a belt connected to engine output. The mechanical relationship detracts horsepower from the engine output as a parasitic energy loss. Additionally, a mechanically-driven coolant pump is driven at all times while the engine is rotating, at a speed proportional to the speed of the engine. As a result, there are conditions where significant coolant is circulated even though the temperature of the engine may not necessarily be great enough to require cooling. Moreover, the coolant pump should ensure sufficient cooling even at low engine RPM with higher engine loads. Therefore for normal operations (higher RPM and lower load) a mechanical pump commonly needs to be oversized to meet engine thermal requirements.

According to aspects of the present disclosure, coolant pump 14 is provided as an electrically-powered coolant pump in lieu of a mechanical coolant pump. The electrical coolant pump 14 allows for more engine power through the reduction of drag upon engine output. The electric pump also allows the precise control over how much coolant is cycled through the engine at given engine temperature ranges. Coolant pump 14 enables on-demand pump speed, which may be more efficient and in tunable to the specific cooling needs of the engine 12.

Valve 18 may be actuated by controller 32 to provide a selectable opening to meter coolant flow through the engine cooling system 10. In one example, the valve 18 is a multiple way rotary gate valve that provides a variable range of opening sizes for each opening according to the position of the valve. The valve 18 includes a rotary portion having a number of angular positions, each corresponding to a different orifice size of an opening within the valve. The position of the valve affects the hydraulic resistance of the coolant system and also the load on the coolant pump. Also, precise control of the orifice size allows coolant flow to be metered as compared to merely open or closed. In alternate examples, the opening of the valve may be triggered by external factors such as temperature (for example, a thermostat valve). One advantage to utilizing an active-control variable valve as compared to a reactive control open-closed valve is the avoidance of latency effects, which may be introduced by a time lag and/or hysteresis effects associated with a traditional thermostat valve. An additional advantage realized by utilizing an actively-controlled variable valve is to control the valve opening at a continuous state in order to a more precise flow rate control. In contrast, a traditional thermostat valve usually stays at either closed or opened position without allowing for precise flow rate control.

The various coolant system components discussed herein may have one or more associated controllers to control and monitor operation. Controller 32, although schematically depicted as a single controller, may be implemented as one controller, or as system of controllers in cooperation to collectively manage engine cooling. Multiple controllers may be in communication via a serial bus (e.g., Controller Area Network (CAN)) or via discrete conductors. The controller 32 includes one or more digital computers each having a microprocessor or central processing unit (CPU), read only memory (ROM), random access memory (RAM), electrically-programmable read only memory (EPROM), a high speed clock, analog-to-digital (A/D) and digital-to-analog (D/A) circuitry, input/output circuitry and devices (I/O), as well as appropriate signal conditioning and buffering circuitry. The controller 32 may also store a number of algorithms or computer executable instructions needed to issue commands to perform actions according to the present disclosure.

The controller 32 is programmed to coordinate the operation of the various coolant system components. Controller 32 monitors the temperature of the engine 12 based on a signal from one or more temperature sensors. One or more additional temperature sensors are also disposed in the radiator to monitor the temperature of coolant flow thought the radiator. The controller 32 also monitors operating conditions of the coolant pump 14 and controls power provided to the pump based on the sensed temperatures at various locations in the cooling system 10. The controller 32 additionally controls and monitors the opening of valve 18 to coordinate the valve opening size with the operation of the coolant pump 14 and the cooling needs of the engine 12.

The flow rate of coolant within the engine cooling system 10 directly affects the cooling efficiency of the system. The reduction of the flow rate may, for example, be caused by a loss of coolant volume due to leakage, coolant underfill, or flow obstructions within the circulation circuit (e.g., such as obstructions caused by coolant tube deformation or debris from a failed component). Severe degradation of coolant flow may prevent adequate engine cooling and therefore cause overheating and damage to engine components. For example, as coolant is lost and air begins to cycle through the coolant system, damage may be caused to the cooling system components. Specifically, low coolant leads to pump failure caused by cavitation due to air cycling through the cooling system. It may be advantageous to quantitatively estimate the health status of the of coolant circulation. More specifically, conducting cooling system prognosis to detect cooling system coolant flow rate degradation before an actual temperature increase occurs may avoid premature wear and/or damage to engine components.

Figure 2:
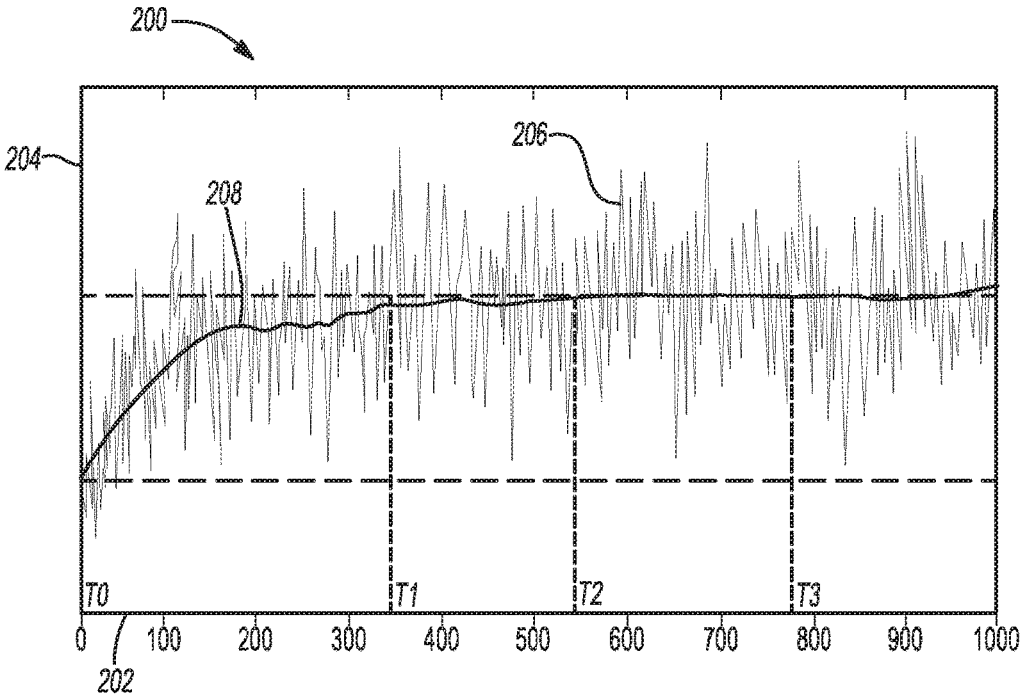
FIG. 2 is a plot of coolant pump speed versus time.

Referring to FIG. 2, plot 200 illustrates pump speed versus time for an example drive cycle where the coolant volume remains constant. The horizontal axis 202 represents time, and the vertical axis 204 represent operational speed of the electric pump in rotations per minute (RPM). Raw speed data is acquired during rotation of the pump and is represented by data set 206. The raw data includes fluctuations in the measured data, and the controller applies a low pass filter to de-noise the data. A filtered data curve 208 is smoothed and represents the pump speed over the course of the drive cycle. The controller monitors the speed data to make an assessment of when the pump speed reaches a steady state speed during operation. In the example of FIG. 2 the controller detects a steady state condition at time T1. Once steady state is detected, the controller delays to allow the steady state condition to remain valid for a preset time threshold prior to using the speed and current data to correlate to pump operation. According to aspects of the present disclosure, the controller implements a predetermined time delay following detection of a steady state operating condition prior to storing data indicative of pump operation. In the example of FIG. 2, the predetermined time period is the duration between time T1 and time T2. More specifically, the controller may be programmed to delay for a specific amount of time (e.g., about 200 ms) after steady state pump speed is detected prior to using the data for subsequent calculations.

Following the predetermined delay, the controller begins to learn pump operating properties at time T2. There is a second predetermined time period over which the controller learns the pump operation by collecting the pump speed, current draw, and power draw data. In the example of FIG. 2, the learning time period is the duration between time T2 and time T3. More specifically, the controller may be programmed to collect pump speed data for learning about pump operational properties for a predetermined time interval (e.g., about 450 ms). The learning time period is set to a duration sufficient to acquire reliable data but is also limited so as not to over-train the model at a singular operating point. As the vehicle is driven at different speed conditions over time, the algorithm collects different data sets over the entire pump speed range and provides more accurate estimates based on the broader overall data set. The steady state pump speed data and corresponding power draw may be used to identify a model where parameters are compared to a stored library to make an assessment of cooling system operational health.

Figure 3:
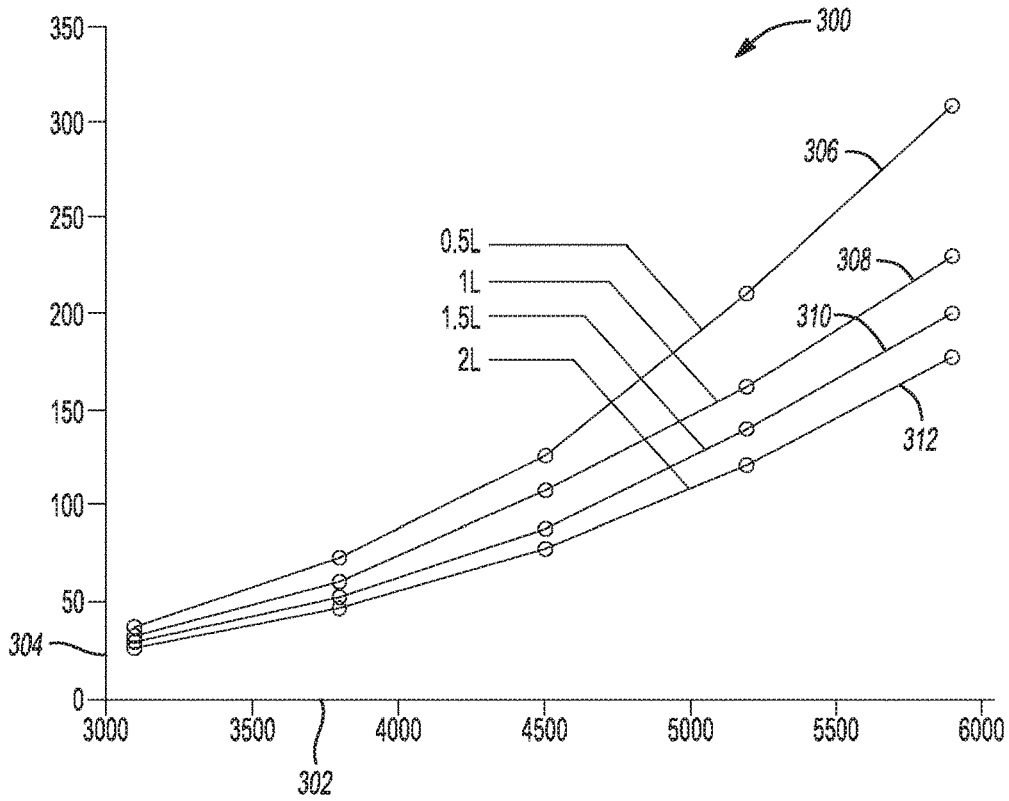
FIG. 3 is a linear scale plot of pump supply power versus pump output speed for a range of leakage conditions.

Referring to FIG. 3, plot 300 depicts pump power draw versus pump speed for a number of different coolant volume conditions at a specific rotary valve position. The horizontal axis 302 represents coolant pump speed across a range of RPM in a linear scale. The vertical axis 304 represents power supplied to the coolant pump for the various pump speeds in a linear scale. Experimental data regarding coolant flow is plotted for various steady state pump speeds and confirms the learning algorithm discussed above. The data points trend into groups each arranged along a curve according to the volume of coolant cycled through the system for each respective data point.

Plot 300 depicts several curves each corresponding to a different volume of coolant lost from the system at a specific rotary valve position. Curve 306 represents a power-speed relationship for a coolant system having lost 0.5 liters of coolant due to leakage. Similarly, curves 308, 310, and 312 represent the same cooling system having lost 1 liter, 1.5 liters, and 2 liters of coolant, respectively. As may be seen from plot 300, the pump energy consumption generally decreases as fluid is lost from the system, which further correlates to the reduction of coolant flow rate and heat exchange effectiveness. However, the relationship between power and speed is nonlinear and may be difficult to correlate, particularly at different valve positions. Power demand increases exponentially as coolant pump speed is increased.

Equation 1 below generally characterizes the power-speed relationship for a closed fluid circuit where P is power supplied to the pump, and N is the rotational speed of the pump. Constants α and β are system constants which relate to flow characteristics of the system.

$$P=\alpha N^{\beta} \tag{1}$$

The pump power is calculated as the product of pump voltage and pump current. It can either be calculated at the power supply side (i.e., $u_{supp} \cdot i_{supp}$) or at the motor side (i.e., $u_{motor} \cdot i_{motor}$), depending on the sensor deployment location.

$$P=u_{supp} \cdot i_{supp}=u_{motor} \cdot i_{motor} \tag{2}$$

Transforming Equation 1 from a linear scale to a logarithmic scale makes the power-speed relationship of the pump into a linear relationship. This is useful because system constants α and β correspond to offset and slope of the linear curve and can be used to characterize a coolant flow resistance function. Equation 4 below shows a linear relationship between P and N present once in the logarithmic domain.

$$\log(P)=\log(\alpha N^{\beta}) \tag{3}$$

$$\log(P)=\log(\alpha)+\beta \log(N) \tag{4}$$

Figure 4:
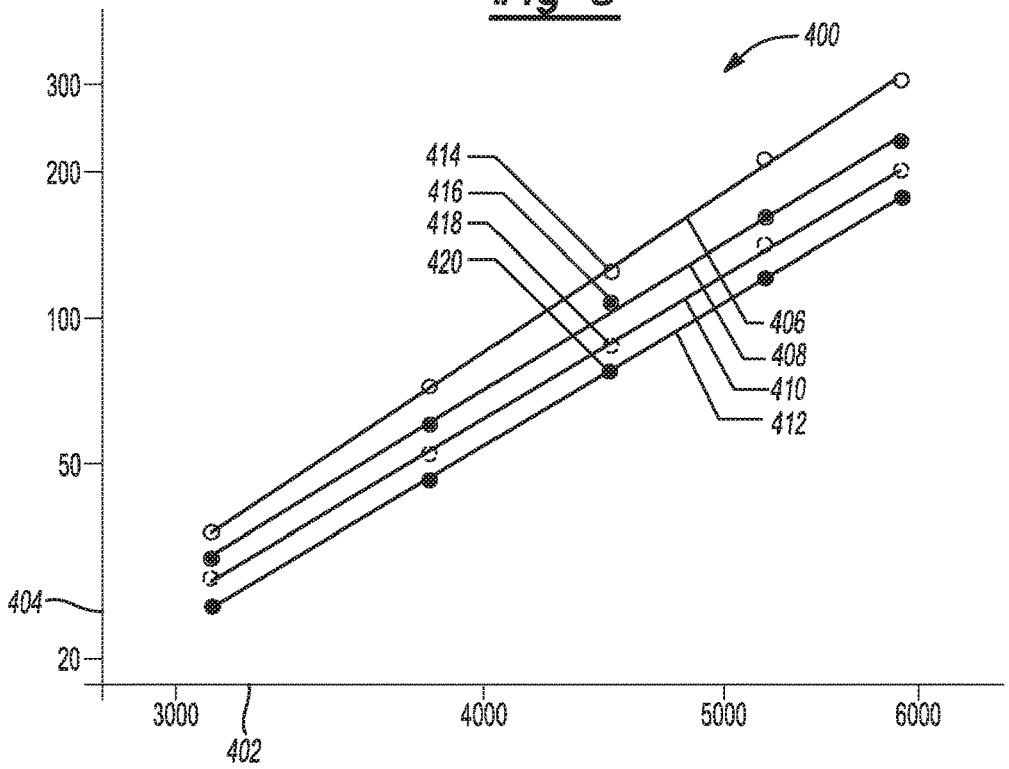
FIG. 4 is a logarithmic scale plot of pump supply power versus pump output speed for a range of leakage conditions of FIG. 3.

Referring to FIG. 4, the data depicted from FIG. 3 is transformed into a logarithmic domain. The horizontal axis 402 represents coolant pump speed in a logarithmic scale. The vertical axis 404 represents power supplied to the coolant pump. Data point set 414 represents the power-speed relationship for a coolant system having lost 0.5 liters of coolant due to leakage. Similarly, data sets 416, 418, and 420, represent the same cooling system having lost 1 liter, 1.5 liters, and 2 liters of coolant, respectively. The conditions represented by the data sets correspond to those presented in FIG. 3 discussed above. When the data sets are overlaid on a logarithmic scale, each data set may be fit to a linear curve. Curves 406, 408, 410, and 412 are each linear and fit to data sets 414, 416, 418, 420 respectively. The offset value α of each of the curves is highly sensitive to changes in the volume of coolant circulating through the system. More specifically, the slope of each curves remains the same (e.g., β may be around 3), but the offset value α of each line decreases as less coolant is cycled through the system or clogging becomes more severe. Thus, baseline values for offset α and slope β may be determined for each vehicle coolant circulation system across a range of coolant volumes or clogging conditions, for example during an initial calibration. If pump current, as opposed to pump power, is used to correlate with pump speed, a linear relationship is still present, but the slope β may be around 2.

As data is acquired during coolant pump operation as discussed above, these data maybe used to identify the current curve parameters, which are compared with baseline values. A recursive least squares (RLS) algorithm is applied to identify the linear model relating coolant pump power load and pump speed in real time. The real-time relationship of coolant pump speed and power draw can indicate volume of coolant lost from the coolant system or clogging severity independent of a subsequent temperature rise in engine components. According to aspects of the present disclosure, an on-board processor performs an estimation of the real-time performance of the coolant system. Performance data may subsequently be transmitted to an off-board processing system or diagnostic server for determination of remedial actions or preventative maintenance for example. The controller may be in wireless communication with the server to send and receive diagnostic messages regarding cooling system operational health.

Figure 5:
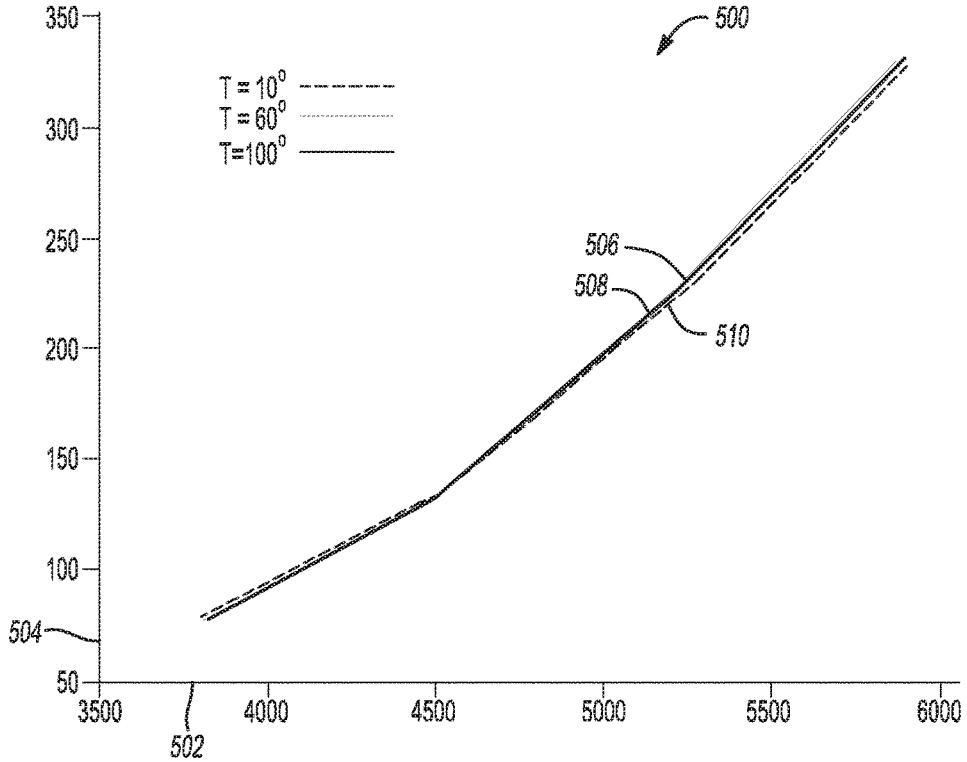
FIG. 5 is a linear scale plot of pump supply power versus pump output speed for a range of temperature conditions.

The power-speed relationship for the coolant pump is robust against many of the operational variables of the coolant system. For example, the relationship is not sensitive to changes in coolant temperature. Referring to FIG. 5, plot 500 characterizes the power-speed relationship of the coolant pump for a range of operating temperatures. Horizontal axis 502 represents coolant pump speed, and vertical axis 504 represents power supplied to the coolant pump. In the example of FIG. 5, data for a coolant system is presented for example temperatures of 10 C (e.g., curve 506), 60 C (e.g., curve 508), and 100 C (e.g., curve 508). As can be seen from plot 500, each of the curves have substantially the same performance characteristics irrespective of the operating temperature. Thus aspects of the present disclosure are effective to detect coolant leaks based on volume changes across a span of different operating temperatures.

Figure 6:
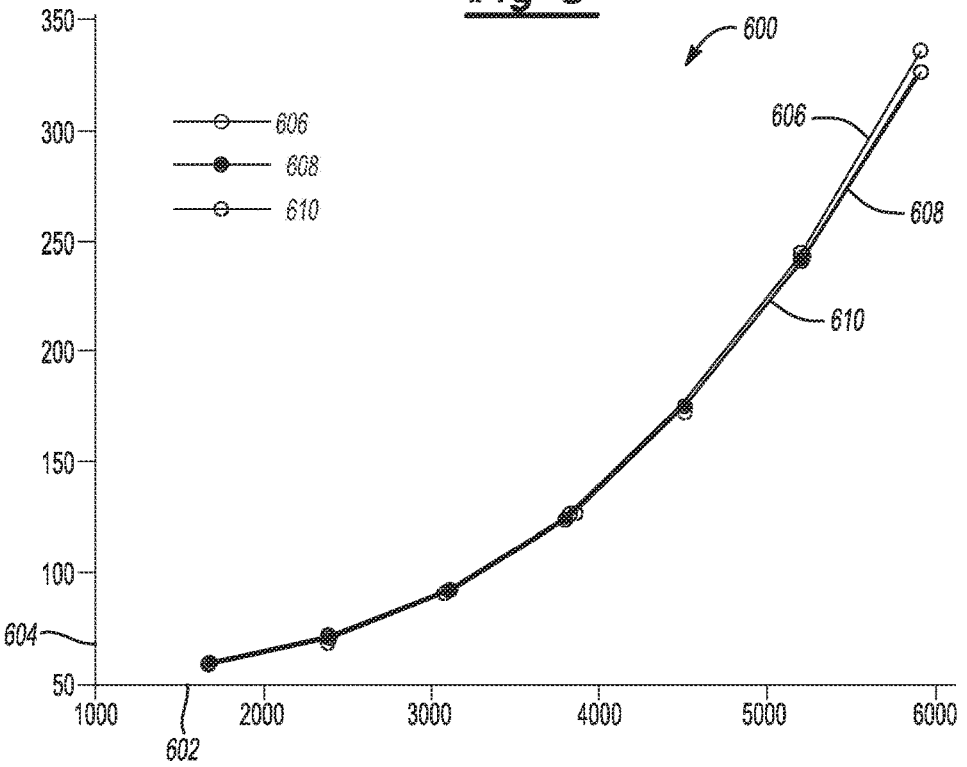
FIG. 6 is a linear scale plot of pump supply power versus pump output speed for a range of pressure conditions.

Likewise, the power-speed relationship of the coolant pump is robust against a range of operating pressures of the coolant system. Referring to FIG. 6, plot 600 characterizes the power-speed relationship of the coolant pump for a range of operating pressures. Horizontal axis 602 represents coolant pump speed, and vertical axis 604 represents power supplied to the coolant pump similar to previous examples. However FIG. 6 presents data for a coolant system operating under example pressures 0 psi (i.e., curve 606), 10 psi (i.e., curve 608), and 20 psi (i.e., curve 610). Each of the curves 606, 608, and 610 has substantially the same performance characteristics irrespective of the operating temperature. Thus aspects of the present disclosure are effective to detect coolant leaks based on volume changes across a span of different operating temperatures.

While robust to several operating variables, the prognosis systems discussed in the present disclosure may be sensitive to changes of other certain operating parameters besides coolant volume. For example the degree to which the variable-opening valve is opened may affect the slope $\beta$ and/or the offset $\alpha$ of the power-speed curves on the logarithmic scale. Yet for each given open position the power-speed relationship of the coolant pump is well correlated. Thus in the case of the rotary gate valve having a number of various open positions, the controller may store a separate algorithm to convert the power-speed relationship into a logarithmic domain for each of a plurality of valve opening positions. In one example, the controller may store an algorithm for each open position of the variable position valve in 10% increments. In this case any of eleven different algorithm sets may be employed depending on the valve position. It should be appreciated that storing multiple algorithms may be used to address other types of variables which affect the speed-power characteristics of the coolant pump. According to aspects of present disclosure, the controller may store a different algorithm corresponding to different discrete values of any variable which affects the power-speed relationship of the coolant pump.

Figure 7:
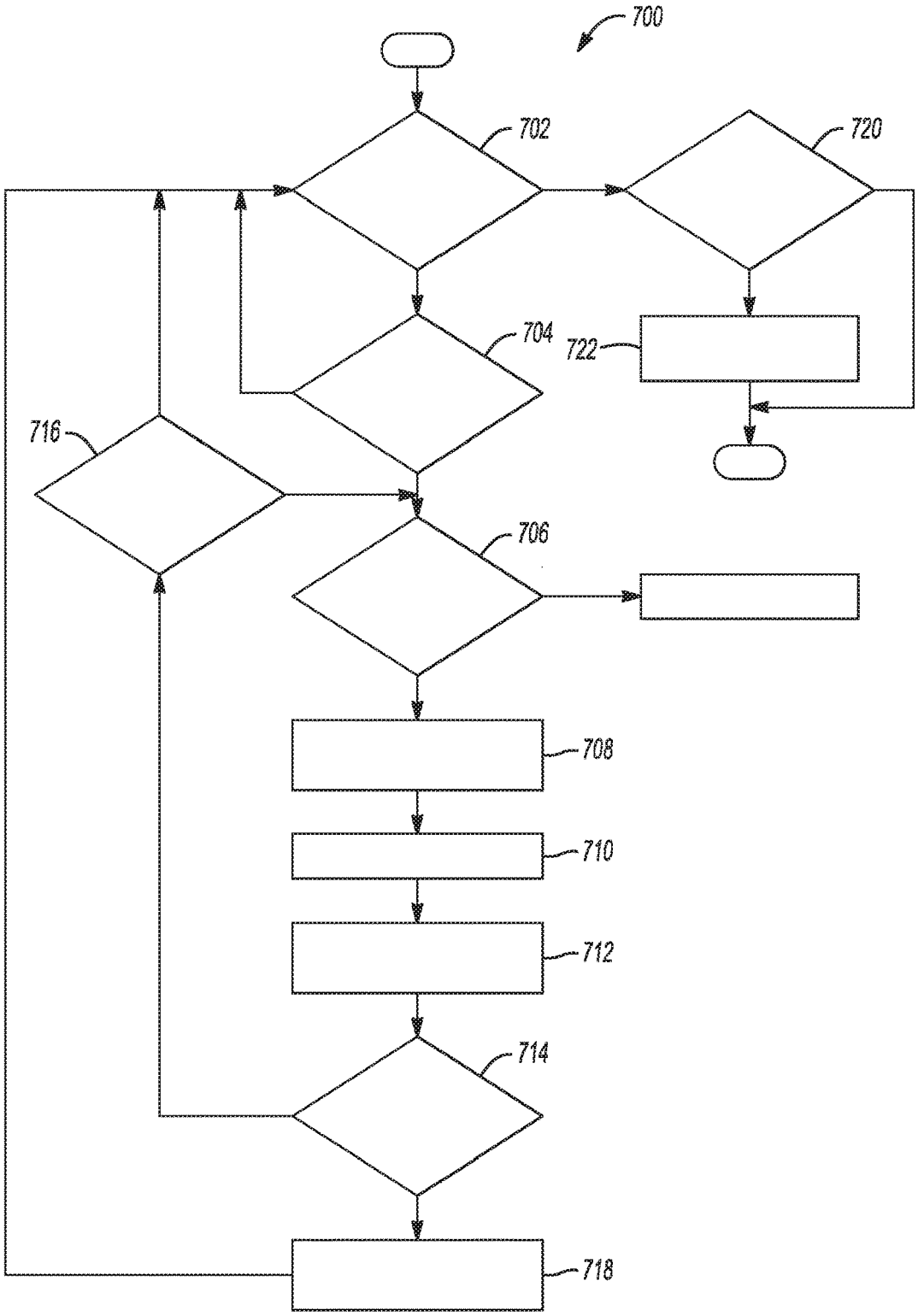
FIG. 7 is a flowchart of a method of conducting a cooling system prognosis based on coolant volume.

FIG. 7 depicts method 700 to detect changes in coolant volume in real-time, prior to adverse effects upon the engine. At step 702 the controller detects whether a drive cycle is currently active or whether the drive cycle has ended. If the drive cycle is currently active at step 702, the controller determines at step 704 whether a steady state has been detected. The controller may apply a low pass filter to the raw data set to remove noise from the signal indicative of the speed of the coolant pump. In one example, the controller stores a number of criteria to determine whether the pump is operating in steady state. For example, the controller may assess (i) whether the coolant pump supply voltage is within a predetermined threshold range, (ii) the commanded pump speed remains relatively constant for a predetermined time period, (iii) the measured pump speed remains relatively constant for a predetermined time period, (iv) the commanded radiator valve position remains relatively constant for a predetermined time period, and/or (v) the measured radiator valve position remains relatively constant for a predetermined time period. A number of different components in the coolant system may be considered to determine the degree of steadiness of pump operation.

If a steady state has been detected at step 704, the controller determines at step 706 whether a diagnostic trouble code (DTC) has been flagged for the coolant pump. If a DTC has been set for the pump, it may indicate a fault with the coolant pump aside from a loss of coolant. In this case, the controller returns to the beginning of the prognosis method and returns to step 702.

If there is no DTC is set at step 706, the controller determines at step 708 the current open position of the radiator variable valve. As discussed above the controller may decide which algorithm to apply based on the valve open position. At step 710 the controller selects the appropriate algorithm to apply based on at least one variable operating condition of the coolant system. According to aspects of the present disclosure, the controller selects an appropriate algorithm based on the current open position of the rotary variable valve.

At step 712 the controller updates the power-speed curve fit estimate. In one example, the controller performs a RLS estimation to determine the coolant pump operation parameters $\beta$ and $\alpha$, which correspond to the slope and offset, respectively, on a logarithmic scale. A beneficial aspect of using RLS estimation is that the technique operates as an adaptive filter. As new steady state sample data is available from the coolant pump, at least one filtering coefficient of the estimation algorithm, and subsequently the estimate curve, is updated. The parameters $\beta$ and $\alpha$ may ultimately be compared to correlated values to make a real-time determination of changes in coolant volume such as those caused by a coolant leak. Another advantage is that estimation significantly reduces the amount of data that needs to be recorded and transmitted to the remote server. Instead of the entire data traces which may be data-heavy, only the estimated parameters $\beta$ and $\alpha$ need to handled.

A step 714 the controller assesses whether the duration of the data acquisition period is sufficient to have a confident estimate of the parameters $\beta$ and $\alpha$ of the current operating conditions. If at step 714 there is insufficient duration of data acquisition, the controller assesses at step 716 whether the coolant pump remains in steady state operation. If at step 716 the coolant pump remains in steady state, the controller returns to step 706 to check for an active DTC related to a coolant pump fault. However, if at step 716 the coolant pump has left steady state operation, the controller returns to step 702 to continue to monitor for steady state operation during the present drive cycle.

If at step 714 the duration of the data acquisition, or event learning, is long enough to provide an adequate estimate, at step 718 the controller stops updating the estimates of the curves representing operation of the cooling pump, and returns to step 702 to assess whether the current drive cycle remains active. This helps to avoid over-training of the model at a specific operating point.

If at step 702 the drive cycle has ended, the controller assesses at step 720 whether the collective learned data sets are mature enough to store as an indication of long-term coolant pump operation. Total effective samples used for updating the estimates for a given drive cycle will be counted and the number of samples needs to be larger than the threshold sample count to be considered a valid learning cycle. If at step 720 the collective data acquired during the drive cycle is mature, the controller stores at step 722 the estimated pump operating parameters as an indicator of historical pump performance. In some examples step 722 may include uploading the stored data to an off-board server for further analysis.

The processes, methods, or algorithms disclosed herein can be deliverable to/implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components. Such example devices may be on-board as part of a vehicle computing system or be located off-board and conduct remote communication with devices on one or more vehicles While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. An engine coolant system comprising:

a variable-opening valve connected to a plurality of tubes in fluid flow communication with an engine block and a radiator;

an electrically-powered pump arranged to cycle coolant through the radiator and the engine block to regulate an engine temperature; and a controller having a central processing unit and memory, wherein the controller is programmed to store in memory a baseline relationship between pump speed and pump power draw using a nonlinear scale, detect a steady state operating condition of the pump, identify an operational relationship between real-time pump speed and pump power draw, and detect a coolant leak based on a deviation between the baseline relationship and the operational relationship, wherein at least one of the detections or the identification is performed using the central processing unit.

2. The engine coolant system of claim 1 wherein the variable-opening valve to regulate coolant flow between a radiator pass and a bypass, wherein the controller is further programmed to estimate a unique logarithmic relationship between pump speed and pump power draw for each of a plurality of valve opening sizes.

3. The engine coolant system of claim 1 wherein the controller is further programmed to detect the steady state operating condition based on at least one of: (i) a commanded pump speed being substantially constant, (ii) a measured pump speed is substantially constant, (iii) a commanded variable-opening valve position being substantially constant (iv) a measured variable-opening valve position being substantially constant, and (v) a measured pump current being substantially constant.

4. The engine coolant system of claim 1 wherein the controller is further programmed to implement a predetermined time delay after detecting a steady state operating condition and prior to monitoring the operational pump speed and a pump power draw.

5. The engine coolant system of claim 1 wherein the controller is further programmed to implement a maximum learning timer for a steady state learning event to limit data used to identify the operational relationship.

6. The engine coolant system of claim 1 wherein the controller is further programmed to transmit performance data of the coolant system to an off-board server.

7. The engine coolant system of claim 1 wherein the flow characteristic is insensitive to at least one of a coolant temperature and a coolant pressure.

8. The engine coolant system of claim 1 wherein the baseline relationship between pump speed and pump power draw is correlated using a logarithmic scale.

9. A method of detecting a coolant flow anomaly comprising:

setting a baseline value for a coolant flow characteristic based on a logarithmic relationship between stored operational speed data and stored power draw data;

monitoring a speed characteristic and a power draw characteristic of an electrically-powered coolant pump;

in response to detecting a steady state operational speed of the coolant pump, storing data indicative of pump operational speed and pump power draw over a predetermined learning time duration; and detecting a reduction in a volume of coolant based on a deviation between an operational value and the baseline value of the coolant flow characteristic, wherein at least one of the setting, monitoring, or detecting steps is performed using a central processing unit of a controller and at least some data is stored on memory of the controller.

10. The method of claim 9 further comprising selecting one of a plurality of algorithms to detect the reduction in the volume of coolant based on a detected position of a variable-opening valve.

11. The method of claim 9 further comprising updating the baseline value of the coolant flow characteristic based on a relationship between real-time pump speed and real-time pump current.

12. The method of claim 9 further comprising causing a predetermined time delay following detecting the steady state operational speed and prior to storing data indicative of pump operational speed and pump power draw.

13. The method of claim 9 further comprising transmitting data indicative of the reduction in the volume of coolant to an off-board diagnostic server.

14. The method of claim 9 wherein the steady state operational speed is detected based on at least one of: (i) a commanded pump speed being substantially constant, (ii) a measured pump speed is substantially constant, (iii) a commanded variable-opening valve position being substantially constant (iv) a measured variable-opening valve position being substantially constant, and (v) a measured pump current being substantially constant.

15. A vehicle coolant leak detection system comprising:

a controller having a central processing unit and memory, the controller being programmed to store in memory a baseline value for a coolant flow characteristic indicative of an initial volume of coolant, detect a speed characteristic and a power draw characteristic of an electrically-powered coolant pump, in response to detecting a steady state operational speed of the coolant pump, estimate a real-time value for the coolant flow characteristic based on a relationship between pump operational speed and pump power draw over a predetermined learning time duration, and detect a reduction in a volume of coolant based on a change in the coolant flow characteristic from the baseline value, wherein at least one of the detections or the estimation is performed using the central processing unit.

16. The vehicle coolant leak detection system of claim 15 wherein the coolant flow characteristic is based on a logarithmic relationship between calibrated pump speed data and calibrated pump power draw data.

17. The vehicle coolant leak detection system of claim 15 wherein the controller is further programmed to, in response to detecting a reduction in volume of coolant greater than a threshold, transmit data indicative of the reduction in the volume to an off-board diagnostic server.

18. The vehicle coolant leak detection system of claim 15 wherein the controller is further programmed to store a unique logarithmic relationship between stored operational speed data and stored power draw data for each of a plurality of positions of a variable-opening valve.

19. The vehicle coolant leak detection system of claim 15 wherein the controller is further programmed to detect the steady state operational speed based on at least one of: (i) a commanded pump speed being substantially constant, (ii) a measured pump speed is substantially constant, (iii) a commanded variable-opening valve position being substantially constant (iv) a measured variable-opening valve position being substantially constant, and (v) a measured pump current being substantially constant.

20. The vehicle coolant leak detection system of claim 15 wherein the controller is further programmed to implement a predetermined time delay after detecting the steady state operational speed and prior to storing data indicative of pump operational speed and pump power draw.

* * * * *